US008794614B2

(12) United States Patent
Friis

(10) Patent No.: US 8,794,614 B2
(45) Date of Patent: Aug. 5, 2014

(54) EXPANDABLE WORKBENCH AND A METHOD OF USE

(76) Inventor: Lasse Friis, Vanløse (DK)

( * ) Notice: Subject to any disclaimer, the term of this patent is extended or adjusted under 35 U.S.C. 154(b) by 0 days.

(21) Appl. No.: 13/824,033

(22) PCT Filed: Sep. 19, 2011

(86) PCT No.: PCT/DK2011/050352
§ 371 (c)(1),
(2), (4) Date: Mar. 15, 2013

(87) PCT Pub. No.: WO2012/037940
PCT Pub. Date: Mar. 29, 2012

(65) Prior Publication Data

US 2013/0181388 A1 Jul. 18, 2013

(30) Foreign Application Priority Data

Sep. 23, 2010 (DK) ..... 2010 00858

(51) Int. Cl.
*B25B 1/00* (2006.01)

(52) U.S. Cl.
USPC ..... 269/289 R; 269/291

(58) Field of Classification Search
USPC ..... 269/289 R, 291, 900, 37, 71, 229, 310; 29/281.1, 281.3, 281.5
See application file for complete search history.

(56) References Cited

U.S. PATENT DOCUMENTS

| | | | | |
|---|---|---|---|---|
| 4,854,531 | A | 8/1989 | Esposito | |
| 5,649,731 | A * | 7/1997 | Tognetti | 296/26.09 |
| 5,709,256 | A * | 1/1998 | Thormeier | 144/286.1 |
| 5,725,205 | A * | 3/1998 | O'Berg | 269/37 |
| 5,947,460 | A * | 9/1999 | Williams | 269/37 |
| 6,113,088 | A * | 9/2000 | Gakhar et al. | 269/139 |
| 6,412,764 | B1 * | 7/2002 | Hebert | 269/45 |
| 7,448,606 | B1 * | 11/2008 | Johnson | 269/17 |
| 7,891,646 | B2 * | 2/2011 | Terry | 269/41 |
| 2002/0130456 | A1 | 9/2002 | Hebert | |
| 2006/0207685 | A1 | 9/2006 | Welsh et al. | |

FOREIGN PATENT DOCUMENTS

FR 2809652 12/2001

OTHER PUBLICATIONS

International Search Report and Written Opinion, PCT/DK2011/050352, mailed Feb. 7, 2012.

* cited by examiner

*Primary Examiner* — Lee D Wilson
(74) *Attorney, Agent, or Firm* — Winston & Strawn LLP

(57) ABSTRACT

An expandable workbench that includes one or more expansion members slidingly connected to a frame, with the one or more expansion members expandable in a plane P between a first retracted position and a second expanded position. The workbench also includes a plurality of receiving members, each of which includes a receiving groove with a longitudinal axis L, with the longitudinal axis of the receiving grooves being at least pair wise parallel to each other and the plane P, and each of the one or more expansion members being equipped with one of the plurality of receiving members, such that the expansion members expand diagonally from the center of the frame.

14 Claims, 4 Drawing Sheets

EXPANDABLE WORKBENCH AND A METHOD OF USE

BACKGROUND

The present invention relates to an expandable workbench comprising one or more expansion members slidingly connected to a frame, the one or more expansion members are expandable in a plane P between a first retracted position to a second expanded position.

Existing expandable workbenches are generally designed for supporting e.g. larger boards of various sizes when cutting or otherwise working with said boards. Furthermore said workbenches are often designed to relate to specific power tools such as a saw. Whereas such a bench may be useful when handling large boards e.g. when cutting boards or similar, they are not suited for help in the assembling of structures in a predefined mutual relationship requiring a workbench adjustable in more directions and with means for keeping at least some of the of the elements in the structure in a defined relationship to each other.

The American patent application (US 2006/0207685) relates to a portable work bench. The bench includes a beam and legs for supporting the beam. Expansion members are slidingly connected at the two ends of the beam, and each expansion member holds a receiving member. The receiving members comprise two surfaces, i.e. a first surface parallel with and a second surface perpendicular with the plane of the beam. Said two surfaces define an axis perpendicular to the sliding direction of the expansion members. The axes related to the two receiving members are parallel so that they together can receive and hold a workpiece. However, the bench is not suited for helping in assembling structures in a predefined mutual relationship as described above.

For example the assembling of embrasures for windows most often requires more than one person, as boards are to be assembled precisely aligned relatively to each other and in a way which requires that the boards are kept stable with their width direction in a vertical direction. If only one person is to assemble such an embrasure it requires quite laborious arrangements of support tools such as cramps, which often will not have the necessary degrees of freedom in their adjustment and will be rough on the boards leaving marks disfiguring the finished embrasures.

Thus there is a need for an expandable workbench which is adjustable in several directions and which may support several objects in a predetermined relationship.

SUMMARY OF THE INVENTION

In a first aspect according to the present invention is provided an expandable workbench as mentioned in the opening paragraph which allows a single person to perform assembly of structures which otherwise may require more than one person.

In a second aspect according to the present invention is provided an expandable workbench as mentioned in the opening paragraph which is low weight.

In a third aspect according to the present invention is provided an expandable workbench as mentioned in the opening paragraph which is easily transported and stored.

In a fourth aspect according to the present invention is provided an expandable workbench as mentioned in the opening paragraph which improves the physical working environment for the user.

In the present application embrasure or slay is used for the structure, often a wooden panel frame, which bounds an opening in a wall wherein a window or door is arranged.

The novel and unique way these and other advantages are achieved is by that the workbench further comprises a plurality of receiving members each receiving member comprises a receiving groove with a longitudinal axis L, the longitudinal axis L of the receiving grooves are at least pair wise parallel to each other and the plane P, and each of the one or more expansion members is equipped with one of the plurality of receiving member.

The receiving members makes it possible to rest an object in a specific position in contrast to where simple expansion members are used, which in general only are suitable for resting an object in its horizontal position. E.g. expansion members on a saw bench is used for supporting a large board in its horizontal position if the area of the board is too large to lie on the main work area of the saw bench.

The receiving grooves makes it possible to rest one or more objects with the object's width direction vertically. The number of objects which can be supported depends on the number of receiving elements. Preferably the workbench is arranged so that an object is supported by more than one receiving member.

The parallel grooves in the receiving members makes it easy to align a number of objects parallel to each other. And when at least some of the receiving members are mounted on the expansion members it is possible to arrange the objects in a desired distance from each other by expanding or retracting the expansion members.

The receiving grooves allows objects e.g. wooden boards to be placed and supported with their width direction upright i.e. perpendicular to the plane P or vertically without the use of traditional means such as cramps which may damage the supported objects. Thus the present invention provides a more gentle handling of objects to be assembled using the expandable workbench.

It is possible that all receiving members are fastened to expansion members or a number e.g. two receiving members are fastened directly to the frame.

Preferably a receiving member is fastened at the distal end of each expansion member.

In preferred embodiments the receiving members are fabricated to be as light weight as possible. Light weight structures can be formed by using light weight materials as e.g. aluminum which may be pressed, bend or otherwise shaped to form a receiving member. Low weight can also be achieved by having at least partly hollow receiving members. However the receiving members may also e.g. be cast in a sturdy plastic or rubber.

The frame is preferably square or rectangular with a shape suitable for the structures to be assembled by use of the present invention as this simplifies the adjustment of the expansion members.

The frame is preferably made of a sturdy and/or light weight material. Suitable materials may e.g. be iron, aluminum or other metals or even heavy duty plastic.

Depending on the number of expansion members and hereby the minimum number of receiving members, the expandable workbench can support a number of objects in one or more points. If for example the workbench according to the present invention comprises at least four expansion members there will be at least four receiving members and thereby at least four support points supporting one or more objects. As the receiving members are arranged on the expansion members, the relative position of the receiving members can be adjusted to fit e.g. two long boards if the receiving members are aligned pair wise. Hereby the four receiving members on the expansion members provide two support points for each board, which boards may be kept with their width direction perpendicular to the plane P and parallel without the need for human interaction. The operator is thus free to perform other task, e.g. assembling a third board to the two boards kept by the expandable workbench. Furthermore the expandable workbench relives the personnel from straining physical work.

The expansion members expand diagonally from the center of the frame. The distance between the receiving members will thus increase when the expansion members are expanded. This means that the distance between two boards each resting in two receiving members will increase when the expansion members are expanded, as well as the distance between the two receiving members supporting each board will increase.

When supporting objects such as boards or similar it is an advantage that each board is supported in more than one point and that these points are situated with some distance to each other in order to help keep the supported object in balance even when work is being carried out on or around said object. The longer such an object is the further apart such support points, in the present case receiving members, may advantageously be. Thus it is an advantage that it is possible to regulate the distance between the receiving members in more than one direction as the expansion members expands diagonally from the center of the frame.

In a preferred embodiment the expandable workbench according to the present invention comprises a table part preferably comprising one or more table grooves parallel to the receiving grooves. A table part can advantageously be a table top covering at least part of the frame and used for temporary storing tools and other parts needed when using the workbench.

When the table part comprises table grooves running parallel to the receiving grooves in the full width/length of the table part, the table grooves can be used if it is needed to arrange objects such as boards with a smaller distance to each other than possible when using the receiving grooves in the receiving elements. Thus the addition of table grooves enhances the flexibility of the expandable workbench as they allow for a wider range of distances between two objects supported by the expandable workbench.

In an other preferred embodiment the expansion members in their first retracted position is at least partly retracted into the frame. This is for example achieved if the expansion members are telescopically integrated into the frame and has the advantage that no other means needs to be arranged on the frame or workbench in order to hold and guide the expansion members. If the expansion members can be fully or almost fully retracted into the frame, the expandable workbench takes up a minimum of space when not in use or during transport.

The expandable workbench may be arranged to be collapsible preferably to a compact structure i.e. if the expandable workbench is fitted with a support or leg structure which may be folded and/or telescopically collapsed in to a state taking up minimum space.

The support- or leg-structure may advantageously have means to adjust the working height of the expandable workbench to suit working conditions and the height of the user to ensure optimized working posture for the user. The adjusting means may for example be telescopically arranged tubular legs.

If the table part is shaped to contain expansion elements, receiving elements and/or support or leg structure in its collapsed state, the expandable workbench becomes easy to store and transport. Preferably the expandable workbench in its compact and collapsed state forms a box like shape defined by the table part, i.e. all collapsible elements may be completely contained in the table part. A regular shape such as a box shape when resting flat on a car floor or in a storage area allows other things to be placed on top, as the box shaped collapsed expandable workbench forms a stable fundament. A regular shape with no protruding elements also prevent entanglements in other equipment and allows the expandable workbench to be stored in even a narrow place.

The table part is preferably made of a light weight but still sturdy materials such as pressed PVC or other plastic. But it may also be of e.g. wood or pressed or cast metal if for example a heavier workbench is needed or a specific design is desired.

Advantageously each expansion member comprise one or more locking members for locking said expansion member in a predetermined or ad hock position. When the expansion members can be locked it is possible for the personnel to decide how far apart he/she wants the receiving members to be and then lock the expansion members in this relative position. Hereafter one or more objects, e.g. a board, can be positioned in the receiving members without risk of the receiving members being dislocated, which would result in an unintended distance between the boards. It is possible that the expansion members also contains markings indicating specific positions. For example when the workbench is used for assembling embrasure and/or slays for windows or doors, markings can indicate positions of the expansion members and hereby receiving members needed when making embrasure and/or slays for windows or doors fitting different standard size windows or doors. Similarly markings may indicate measurements for other structures.

When the receiving members comprise two opposing open first sides connected by two opposing walled second sides the receiving members contains a U-shaped receiving groove. Depending on the height of the walls on the walled second sides, the receiving elements may support boards of different widths placed in the receiving element with the width direction upright/vertically. This is an advantage when assembling embrasure and/or slays for windows or doors or other frames or semi boxlike structures, as the boards would simply fall over into a horizontal position if the receiving elements does not contain receiving grooves, but for example are flat. The width of the receiving groove may be chosen to fit the typical thickness of boards used and thus no other tightening means are necessary. On the other hand, if needed, locks or e.g. wedges may be used to prevent the boards from moving when supported in the receiving members or it is possible that the receiving members may comprise means to adjust the width of the groove.

In preferred embodiments the receiving members are constructed to receive boards of a 12 mm thickness and thus the width of the receiving grooves are around 15 mm. If thinner or thicker boards are used, the width of the grooves may permanently or adjustably be in e.g. the interval of 10-100 mm.

The walls of the walled second sides must be high enough to support the boards used. Typically the height of the walls, and hereby the groove depth, can be in the interval of 25-80 mm. Heavier larger boards may require deeper receiving grooves.

When both of the first sides are open the boards or other objects can be arranged so that the ends of the boards are free allowing the assembly of boards end to end. It also allows for the use of board of any length contrary to if one end of each groove was closed and thus made to receive only the end of a board.

Typically the objects supported by the expandable workbench according to the present invention are wooden or wood based boards, but it may also be other types of timber or glass, plastic etc. Advantageously the present invention is used for assembling structures of objects whereof at least some are to be kept in an upright vertical/not stable position thus needing the support from the receiving grooves.

The invention also relates to a method of using an expandable workbench according to the invention. Said method comprising the steps of

- Expanding the expansion members until the receiving members is in a desired distance from each other,
- Placing a first board resting in at least one first receiving member with its width direction perpendicular to the plane P,
- Placing a second board resting in at least one second receiving member with its width direction perpendicular to the plane P,
- Fixing a third board connecting the first board and the second board,
- Fixing a fourth board between the first board and the second board, and
- Removing a structure comprising the first, second, third and fourth board from the expandable workbench.

The above mentioned method for using an expandable workbench according to the present invention allows a single person to assemble frame structures which previously would require more than one person or require work performed in awkward straining positions. Furthermore the method allows the person to arrange the boards carefully in the receiving members in order not to scratch or dent delicate surfaces. Also the use of additional tools for keeping the boards in position is not needed, which further speeds up the process and eliminates the risk of damages to the boards.

The method may further comprise any of the steps of

- Locking the expansion members in a use position by means of locking members,
- Unfolding/folding a collapsible support- or leg-structure,
- Collapsing the expandable workbench into a compact structure,
- Fixing the third board to be connecting a first end of the first board and a first end of the second board, and/or
- Fixing the fourth board to be connecting a second end of the first board and a second end of the second board.

Locking the expansion members eliminates or minimizes the risk of unintentional repositioning of one or more of the expansion members and hereby receiving members improving the accuracy of the structures created using the present invention.

If the expandable workbench is equipped with a support or leg structure this may preferably be a collapsible structure which advantageously may be unfolded before use of the present invention and be collapsed again after use when the expandable workbench is stored or e.g. transported.

Also the expansion members may advantageously be partly or completely retracted e.g. into the frame of the workbench in order for the expandable workbench according to the present invention to take up little space and only have a minimum of protruding parts which may be unhandy when stored or transported.

When the third and fourth board is fixed to the first and second end of the first and second board a simple frame structure is achieved.

Use of the Expandable workbench according to the present invention for manufacturing embrasures.

The workbench according to the present invention is especially useful for manufacturing embrasure and/or slays for windows or doors which often needs to fit standard windows. An example is embrasure and/or slays for Velux® windows.

BRIEF DESCRIPTION OF THE DRAWINGS

In the following the present invention will be described with reference to the drawings. All of these embodiments are exemplary and may not be construed as limiting to the invention.

DETAILED DESCRIPTION OF THE INVENTION.

Figure 1:
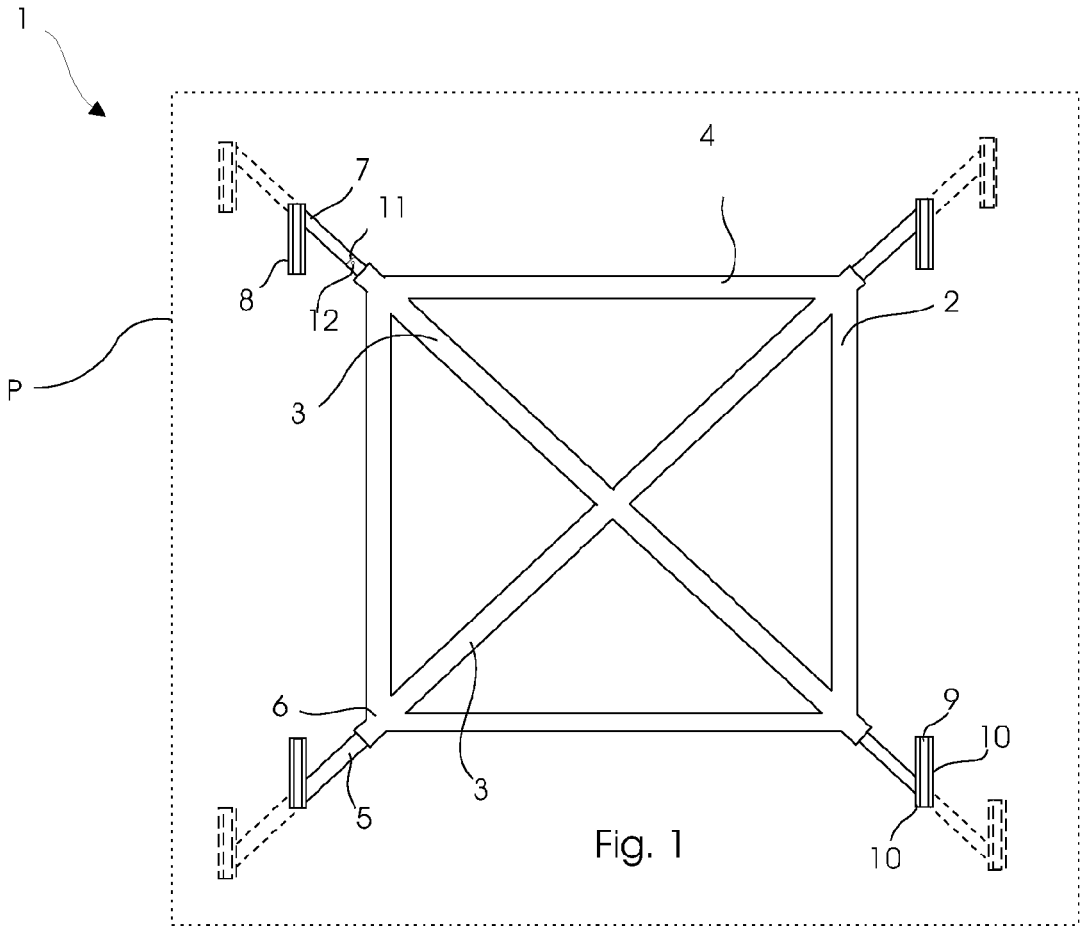
FIG. 1 shows an expandable workbench according to the present invention in an expanded state.

FIG. 1 shows an expandable workbench 1 according to the present invention in an expanded state. The expandable workbench 1 comprises a frame 2 with two diagonal elements 3 and a quadratic round going element 4. Within the two diagonal elements four expansion elements 5 are slidingly arranged to be expanded through each of the four corners 6 of the frame 2. The four expansion members 5 are expanded parallel to a plane P. Each expansion members 5 has a distal end 7 where upon a receiving member 8 is arranged. Each receiving member 8 comprises a receiving groove 9 each defined by two opposing walls 10. In the present embodiment one of the expansion members has a marking 11 and a first lock part 12 for engaging with a second lock part (not shown) on the frame 2. The lock here is exemplary and can within the invention be of an other type or for example be arranged on non or all of the expansion members as well as each expansion members may contain more than one marking and more than one lock. With a dotted line a second expanded state is indicated wherein the expansion members 5 are expanded further and the receiving members 8 thus are further apart.

In both of the expanded states the receiving members 8 and thus the receiving grooves 9 are parallel and pair wise aligned. In this way two boards (not shown) may be arranged to rest on the workbench 1, with each board resting in two receiving grooves 9.

Figure 2:
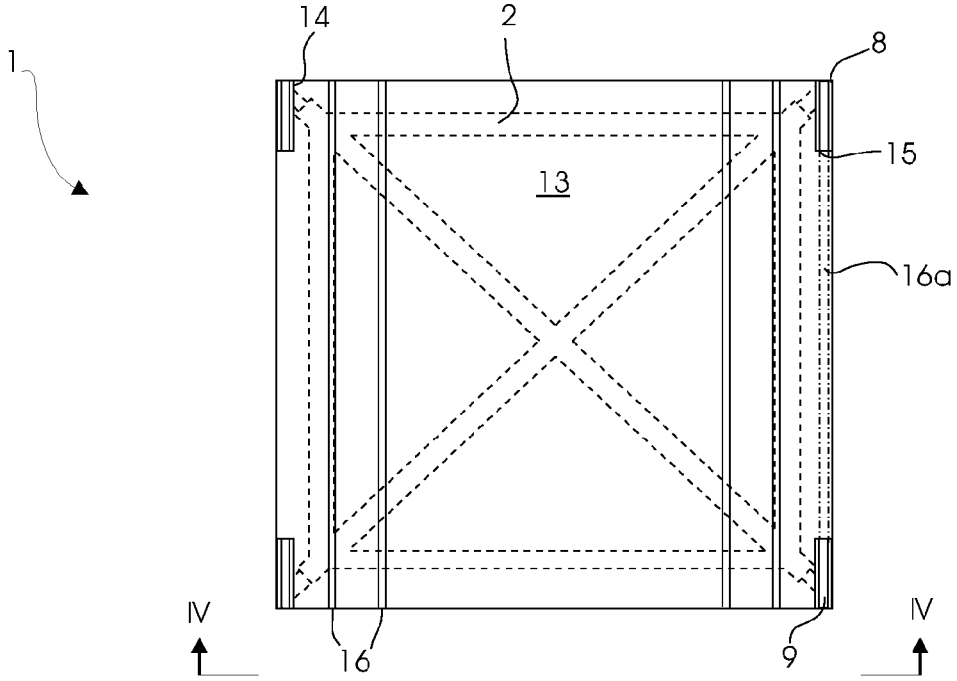
FIG. 2 shows an expandable workbench according to the present invention in a collapsed state seen from the top side.

In FIG. 2 a quadratic table part 13 is added on top of the frame 2 known from FIG. 1. The expandable workbench 1 is shown in its collapsed and most compact state. The frame 2 with expansion members 5 are shown with a dotted line as it is below the table part 13. In each corner 14 of the table part 13 an indentation is made to fit a receiving member 8 in order for the expandable workbench 1 to form a compact structure in its collapsed form with no protruding parts.

In this embodiment two pairs of table grooves 16 are formed across the table part 13 parallel to the receiving grooves 9. The table grooves 16 functions as the receiving grooves 9 but are used when building structures with a required distance between opposing boards less than the minimum distance of opposing receiving grooves 9 in their use position.

In the present case the minimum use position of the receiving members 8 is where the expansion members 5 are expanded just enough for a board to be arranged in two aligned receiving members 8. In the embodiment shown in FIG. 2 a board can not be arranged in two aligned receiving grooves 9 because the expansion members 5 are totally retracted, however if a table groove 16*a* indicated with broken lines was added to connect two receiving grooves 9 in their retracted position it would be possible. This and other various arrangements of table grooves 16 are also within the scope of the present invention.

Figure 3:
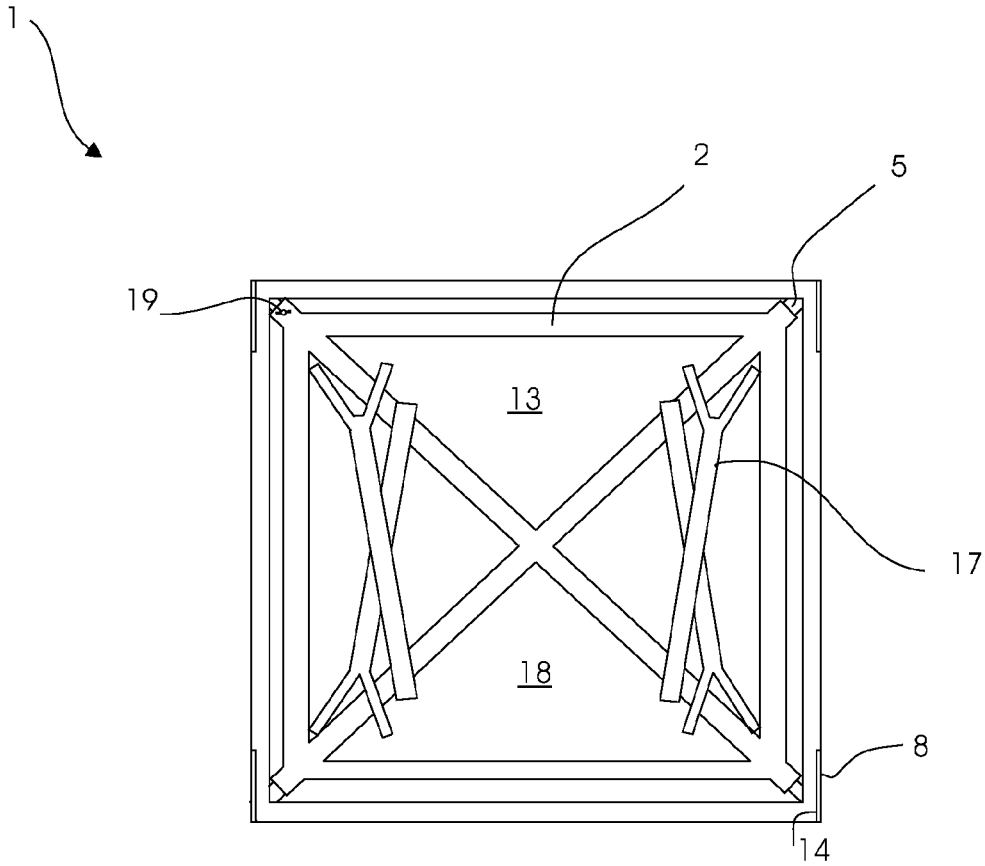
FIG. 3 shows an expandable workbench according to the present invention in a collapsed state seen from the under side.

FIG. 3 is the expandable workbench 1 with table part 13 seen from the underside in its collapsed state. The workbench 1 is fitted with four collapsible legs 17, which in the most collapsed state is folded op and contained in a hollow 18 in the table part 13. The legs 17 are preferably telescopic to allow the user to adjust the height of the unfolded expandable workbench 1 to optimize the work posture of the user as well as to be able to fit into the hollow 18 in a collapsed state.

The frame 4 contains a second lock part 19 for engaging with the first lock part 12 seen in FIG. 1. The lock 12,19 can be of different types e.g. a screw which can be arranged to engage into the first lock part or simply just tighten against the expansion member 5. The lock can e.g. also be a spring biased split engaging in the first lock part 12 or against the expansion member 5. As mentioned earlier one or more locks may be arranged in relation ship with one or more expansion members 5 or non if a simple and cheaper structure is intended.

Figure 4:
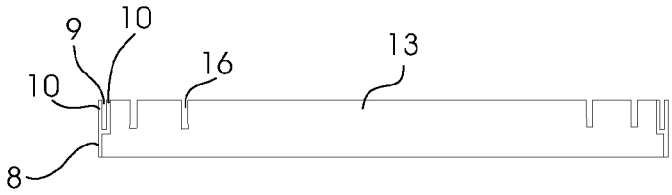
FIG. 4 shows an expandable workbench according to the present invention in a collapsed state seen from side direction indicated in FIG. 2, FIG. 5 an alternative embodiment of an expandable workbench according to the present invention with six expansion members, FIGS. 6*a* and 6*b* each show an exemplary receiving members.

FIG. 4 shows the expandable workbench 1 seen in a side view as indicated in FIG. 2 by arrows IV-IV. The expansion members 5 are in their fully retracted position and the receiving members 8 fits in the indentations 15 in the corners 14 of table part 13. In the present view it is also clearly seen how the table grooves 16 extends through the side of the table part 13.

Figure 5:
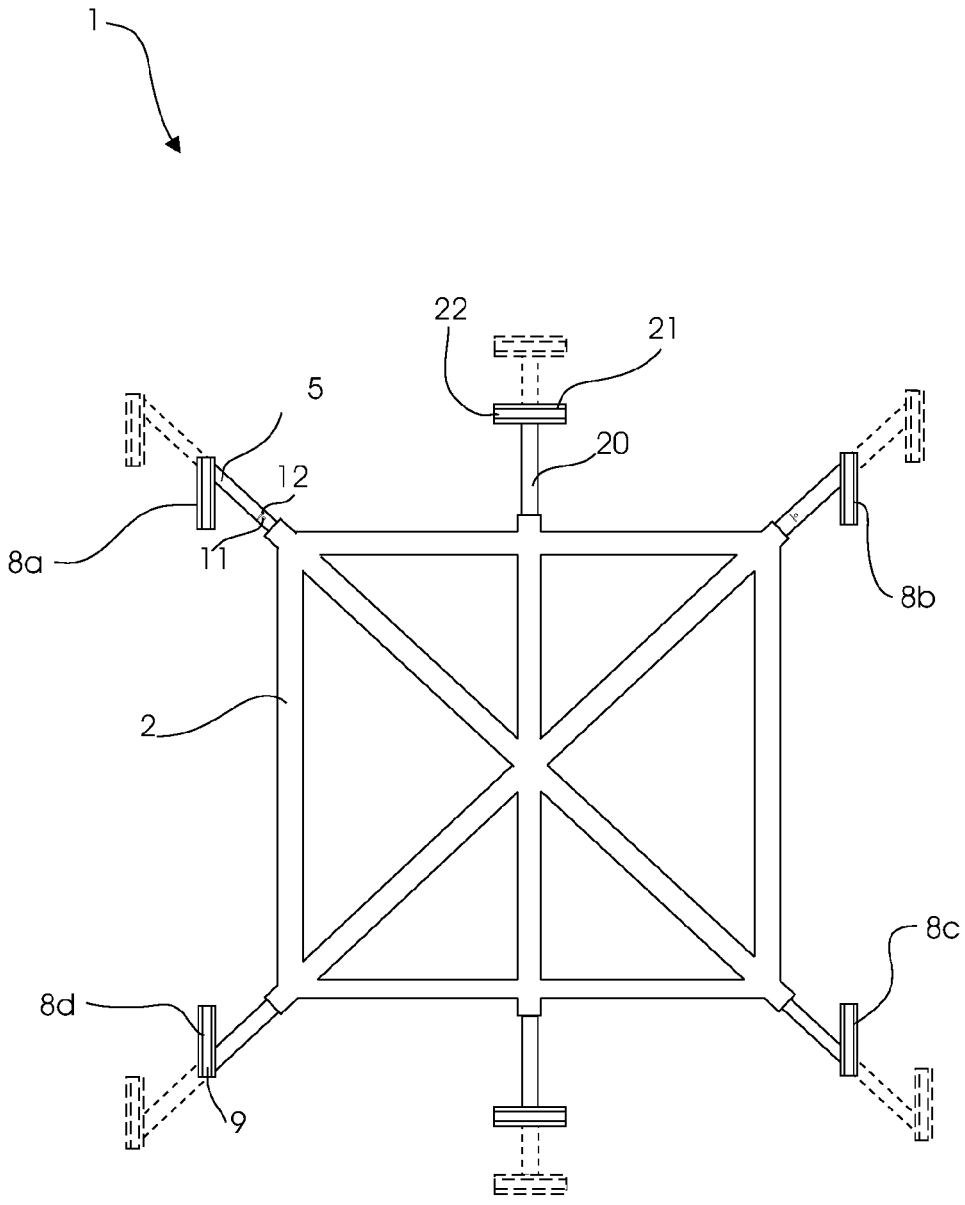

FIG. 5 Shows the expandable workbench 1 known from FIGS. 1-4 in an embodiment with two additional expansion members 20 each with an additional receiving member 21 arranged at the distal end of each additional expansion members 20, said additional receiving members 21 are arranged with their receiving groove 22 perpendicular to the receiving grooves 9 of the original four receiving members 8*a*-8*c*. This embodiment may e.g. be used when the objects to be assembled by use of the expandable workbench 1 are heavy and additional support is needed.

Figure 6A:
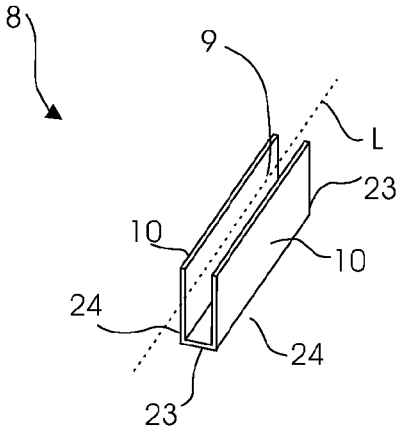

FIG. 6*a* shows a perspective enlarged view of a receiving member 8. The receiving member has two opposing open short sides 23 connected by two opposing longer walled sides 24. The walls 10 of the walled sides 24 are in the present embodiment higher than the open sides 23 are wide forming a U shaped receiving groove 9. The longitudinal axis L of the receiving element is indicated with broken line L.

Figure 6B:
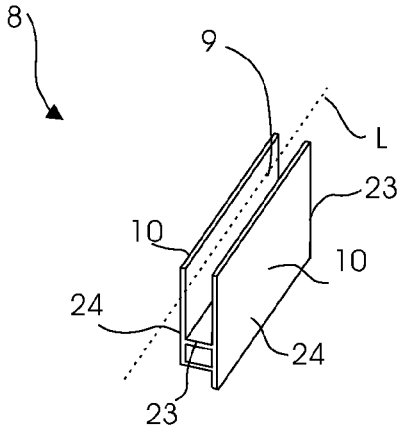

FIG. 6*b* shows an alternative embodiment of a receiving member 8 which can be bent in a single piece of metal e.g. aluminum ensuring a stabile but light weight receiving element 8.

Both of the two described embodiments of receiving members may be used together with the expandable workbench 1 in FIGS. 1-5 and 7. All receiving members in a expandable workbench 1 may be the same or different.

Figure 7:
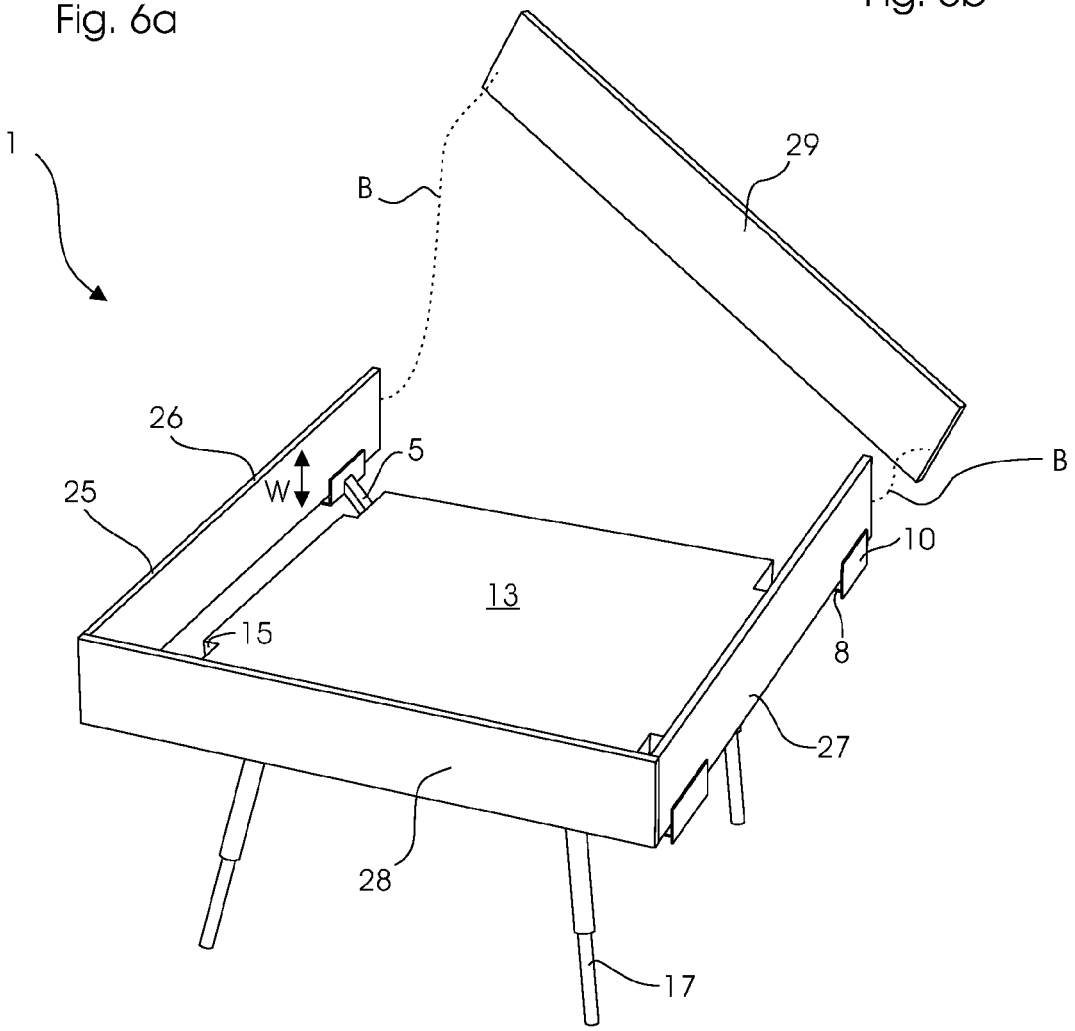
FIG. 7 shows a perspective view of a expandable workbench according to the present invention in use.

FIG. 7 shows an expandable workbench 1 according to the present invention seen in a perspective view. The expandable work 1 bench 1 is standing on four telescopically adjustable legs 17 and is expanded to support parts for a embrasure 25 being assembled. In this example a first board 26 and second board 27 are each resting in two aligned receiving members 8 with their width direction W vertically. A third board 28 has been fixed at a first end of each of the first 26 and second 27 board and a user (not shown) is ready to fix a fourth board 29 at the second end of the first and second board as indicated by broken lines B to complete a frame structure. The present table part is shown without table grooves for clarity but could alternatively have two, three, four or more table grooves.

Thus according to the present invention is provided an expandable workbench which allows a single user to perform task which otherwise would require two persons or would have the user working in an awkward and straining position.

What is claimed is:

1. An expandable workbench comprising:

a plurality of expansion members slidingly connected to a frame, with each of the expansion members expandable in a plane P between a first retracted position to a second expanded position, and a plurality of receiving members, each comprising two opposing open first sides connected by two opposing walled second sides to form a receiving groove with a longitudinal axis L, wherein the two opposing second sides are parallel, with the longitudinal axes of the receiving grooves at least pair wise parallel to each other and the plane P, where the receiving groove allows for use of boards of any length, wherein each of the expansion members is equipped with one of the receiving members, and with the expansion members expanding diagonally from the center of the frame with the diagonally expanding member moving independently with respect to other expansion members.

2. The expandable workbench according to claim 1 comprising at least four expansion members and the receiving members are fastened at the distal ends of the expansion members.

3. The expandable workbench according to claim 1, wherein the expansion members in their first retracted position is at least partly retracted into the frame, and wherein the longitudinal axes of the expansion members do not pass through the center of the frame.

4. The expandable workbench according to claim 1, which is arranged to be collapsible to a compact structure.

5. The expandable workbench according to claim 1, wherein each expansion member comprises one or more locking members for locking the expansion member in a predetermined or ad hock position.

6. The expandable workbench according to claim 1, further comprising a table part comprising one or more table grooves parallel to the receiving grooves.

7. A method of using an expandable workbench according to claim 1, which comprises:

expanding the expansion members until the receiving members are positioned at a desired distance from each other, placing a first board resting in at least a first receiving member with its width direction (W) perpendicular to the plane P, placing a second board parallel to the first board resting in at least a second receiving member with its width direction (w) perpendicular to the plane P, fixing a third board connecting the first board and the second board, fixing a fourth board connecting the first board and the second board, and removing a structure comprising the first, second, third and fourth boards from the expandable workbench.

8. The method according to claim 7 which further comprises one or more for the following:

locking the expansion members in a use position by means of locking members, unfolding a collapsible leg-structure, collapsing the expandable workbench into a compact structure, fixing the third board to be connecting a first end of the first board and a first end of the second board, or fixing the fourth board to be connecting a second end of the first board and a second end of the second board.

9. A method for manufacturing embrasure or slays for windows or doors by the method of claim 7.

10. An expandable workbench comprising:

a plurality of expansion members slidingly connected to a frame, with the expansion members each expandable in a plane P between a first retracted position to a second expanded position, and a plurality of receiving members, each comprising a generally U-shaped receiving groove defined by two opposing wall sides that are parallel and two opposing open sides, where axes perpendicular to the two opposing open sides do not pass through the center of the frame, where the receiving groove allows for use of boards of any length, wherein each of the expansion members is equipped with one of the receiving members, and with the expansion members expanding diagonally from the center of the frame with each of the diagonally expanding members moving independently with respect to the other expansion members.

11. The expandable workbench according to claim 10 comprising at least four expansion members and the receiving members are fastened at the distal ends of the expansion members.

12. The expandable workbench according to claim 10, wherein the expansion members in their first retracted position is at least partly retracted into the frame, and wherein the longitudinal axes of the expansion members do not pass through the center of the frame.

13. The expandable workbench according to claim 10, which is arranged to be collapsible to a compact structure.

14. The expandable workbench according to claim 10, wherein each expansion member comprises one or more locking members for locking the expansion member in a predetermined or ad hock position.

* * * * *